US007788913B2

(12) United States Patent
Midgley et al.

(10) Patent No.: US 7,788,913 B2
(45) Date of Patent: Sep. 7, 2010

(54) MANIFOLD MOUNTED CATALYTIC CONVERTER

(75) Inventors: Mark W. Midgley, Wolverine Lake, MI (US); Glen H. Martin, III, Arlington, TN (US); Richard J. Waggoner, Punta Gorda, FL (US)

(73) Assignee: Indmar Products Company Inc., Millington, TN (US)

( * ) Notice: Subject to any disclaimer, the term of this patent is extended or adjusted under 35 U.S.C. 154(b) by 1240 days.

(21) Appl. No.: 11/355,646

(22) Filed: Feb. 16, 2006

(65) Prior Publication Data

US 2007/0186546 A1 Aug. 16, 2007

(51) Int. Cl.
*F01N 3/10* (2006.01)

(52) U.S. Cl. ..... 60/302; 60/323; 60/299; 60/273

(58) Field of Classification Search ..... 60/302, 60/323; 55/342
See application file for complete search history.

(56) References Cited

U.S. PATENT DOCUMENTS

| | | | | |
|---|---|---|---|---|
| 3,935,705 | A | 2/1976 | Hergoualch | |
| 4,032,310 | A * | 6/1977 | Ignoffo | 422/170 |
| 4,207,661 | A * | 6/1980 | Mase et al. | 29/890 |
| 4,382,808 | A * | 5/1983 | Van Wormer et al. | 55/418 |
| 4,420,933 | A | 12/1983 | Kajitani | |
| 4,448,754 | A | 5/1984 | Isogai | |
| 4,663,934 | A | 5/1987 | Sickels | |
| 4,693,337 | A * | 9/1987 | Timmermeister | 181/231 |
| 5,212,949 | A * | 5/1993 | Shiozawa | 60/298 |
| 5,220,789 | A | 6/1993 | Riley | |
| 5,272,875 | A | 12/1993 | Kaji | |
| 5,431,706 | A * | 7/1995 | Paas | 55/342 |
| 5,724,735 | A * | 3/1998 | Ickes et al. | 29/890 |
| 5,881,554 | A | 3/1999 | Novak | |
| 5,911,683 | A | 6/1999 | Cui | |
| 5,930,995 | A | 8/1999 | Watanabe | |
| 6,491,878 | B1 * | 12/2002 | Locker et al. | 422/179 |
| 6,605,259 | B1 | 8/2003 | Henry | |
| 6,635,227 | B1 | 10/2003 | Shibata | |
| 6,667,013 | B1 | 12/2003 | Nilsson | |
| 6,685,888 | B1 | 2/2004 | Shibata | |
| 6,892,531 | B2 | 5/2005 | Rim | |
| 6,946,013 | B2 | 9/2005 | Alward | |
| 7,552,586 | B1 * | 6/2009 | White | 60/302 |
| 2001/0051117 | A1 * | 12/2001 | Yamada et al. | 422/180 |
| 2002/0076362 | A1 | 6/2002 | Hardesty | |
| 2002/0148416 | A1 * | 10/2002 | Cohen | 123/41.1 |
| 2005/0150222 | A1 | 7/2005 | Kalish | |
| 2005/0191218 | A1 | 9/2005 | Alward | |
| 2005/0214178 | A1 | 9/2005 | LaBarge | |

* cited by examiner

*Primary Examiner*—Thomas E Denion
*Assistant Examiner*—Jesse Bogue
(74) *Attorney, Agent, or Firm*—Wood, Herron & Evans, LLP

(57) ABSTRACT

A combination exhaust manifold and catalytic converter wherein the catalytic converter is in the form of a removable and replaceable cartridge mounted within an opening of an exhaust manifold. This cartridge is supported within the opening of the exhaust manifold by sealing rings and retained within the opening by a removable fastener element.

5 Claims, 4 Drawing Sheets

MANIFOLD MOUNTED CATALYTIC CONVERTER

FIELD OF THE INVENTION

The present invention relates to exhaust systems for combustion engines and, more particularly, to the exhaust manifold and catalytic converter of such systems. In accordance with this invention, the catalytic converter is in the form of a removable and replaceable cartridge mounted within an opening of the exhaust manifold.

BACKGROUND OF THE INVENTION

Exhaust systems for a combustion engine generally include a manifold connected to the combustion engine at one end and bolted to an exhaust pipe at the other end. The exhaust pipe extends a distance from the manifold and generally has a catalytic converter system bolted thereto. These catalytic converter systems generally include a ceramic substrate having a catalyst coated thereon and a metal housing surrounding the substrate. A compressible support mat is usually placed between the ceramic substrate and the metal housing. This support mat functions to accommodate differentials in expansion between the ceramic substrate and the surrounding metal housing, as well as to protect the relatively fragile ceramic substrate from vibration and jarring movement of the engine and exhaust system.

Relatively recently, catalytic converters have been mounted very close to the combustion engine, and in at least one patent disclosure, that of U.S. Pat. No. 6,605,259, within an end opening of the exhaust manifold. When so mounted though, and as disclosed in this patent, the exhaust manifold has had to have end cones formed at the entrance and exit ends of the catalytic converter which is necessarily an expensive casting and assembly practice.

It has been an objective of this invention to provide a catalytic converter which is so mounted within an exhaust manifold that there is no need for the formation of end cones.

Another objective of this invention has been to construct the catalytic converter in such a fashion and to mount it in the exhaust manifold such that it may be easily and conveniently replaced if necessary after protracted use or if it inadvertently fails during use. To that end, the catalytic converter of this application comprises a self-contained cartridge which is removably and replaceably supported within the exhaust manifold of a combustion engine.

SUMMARY OF THE INVENTION

The present invention includes an exhaust manifold mounted catalytic converter cartridge which is positioned within an opening near the exhaust end of the exhaust manifold. The catalytic converter cartridge comprises a catalyst coated ceramic or other conventional material substrate surrounded and retained within a sheet metal shell by a supporting mat. The sheet metal shell is, in turn, supported within the opening in the exhaust manifold by wire mesh seals located at opposite ends of the cartridge. This replaceable cartridge is retained in the opening by a removable fastener element, preferably in the form of an expansible retainer ring located in a groove of the manifold opening and engageable with one of the wire mesh seals at one end of the cartridge and operative to force the complete cartridge against an internal abutment of the manifold at the opposite end of the cartridge.

The primary advantage of this combination exhaust manifold and catalytic converter cartridge combination is that it substantially reduces the cost which has heretofore been characteristic of catalytic converters when placed in the exhaust system of a combustion engine and, additionally, it facilitates replacement of the catalytic converter in the event of a functional breakdown of that portion of the exhaust system.

These and other objects and advantages of this invention will be more readily apparent from the following description of the drawings, in which.

DETAILED DESCRIPTION OF THE INVENTION

Figure 1:
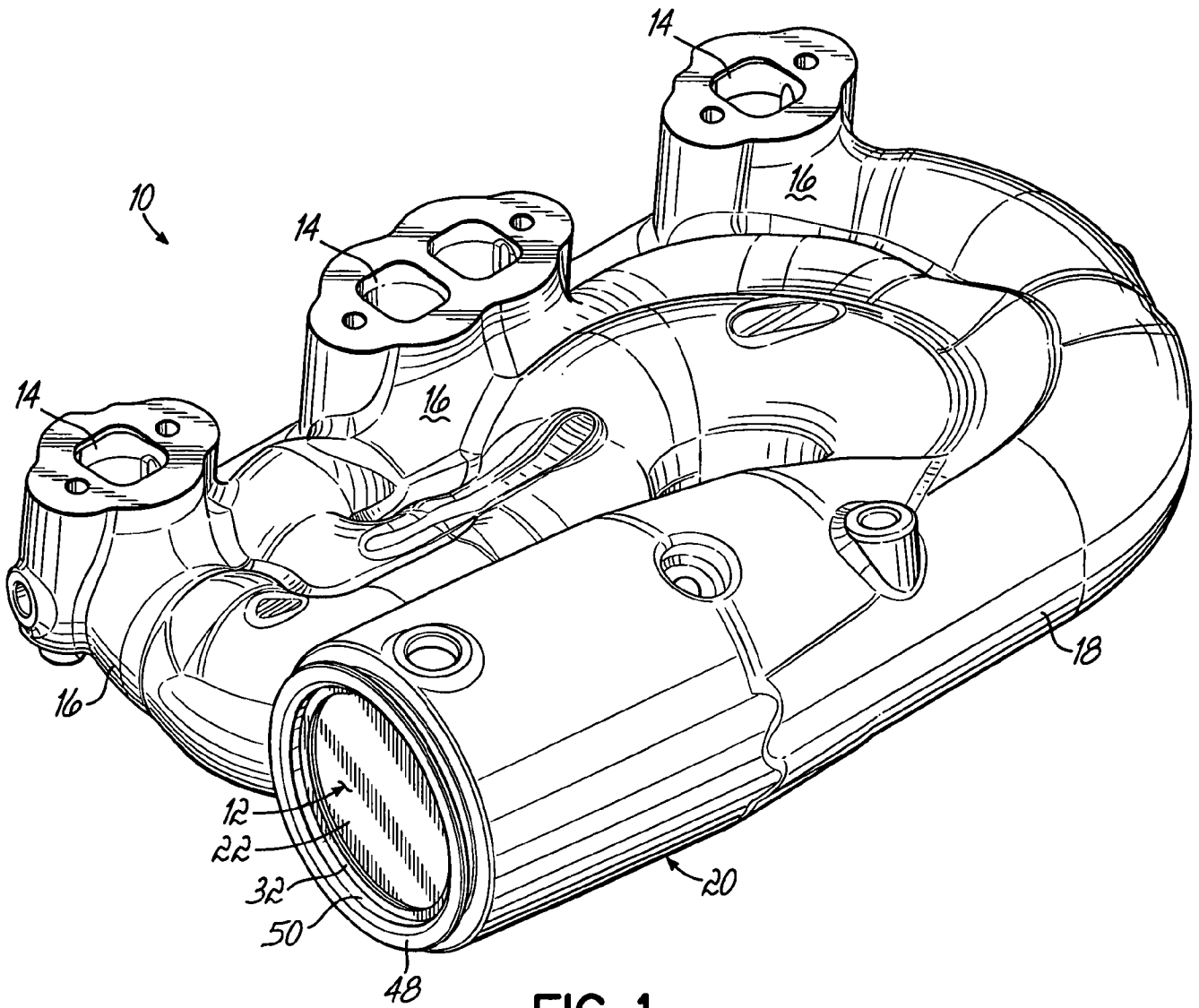
FIG. 1 is a perspective view of an exhaust manifold and catalytic converter cartridge characteristic of the invention of this application.

With reference first to FIG. 1, there is illustrated an exhaust manifold 10 and catalytic converter cartridge 12 for use in combination with that exhaust manifold. The exhaust manifold here illustrated is for use with an internal combustion engine and to that end, has inlet ports 14 adapted to be placed in gaseous fluid communication with the individual cylinders of a combustion engine (not shown) with which the manifold is intended to be used. Each of these inlet ports 14 is connected through conventional duct work 16 to a common inlet duct 18 which in turn opens into the catalytic converter receiving section 20 (hereinafter referred to as the can section) of the exhaust manifold. The exhaust manifold 10 herein described is a water-cooled, dual-walled manifold intended for use in connection with marine engines wherein water is cycled through the manifold so as to control the outer manifold temperature, but the invention of this application is equally applicable to single-walled manifolds used in connection with marine or any other application combustion engine.

In practice, the exhaust manifold is conventionally made from aluminum, but for purposes of this invention, may be made from any material from which manifolds are conventionally manufactured.

Figure 2:
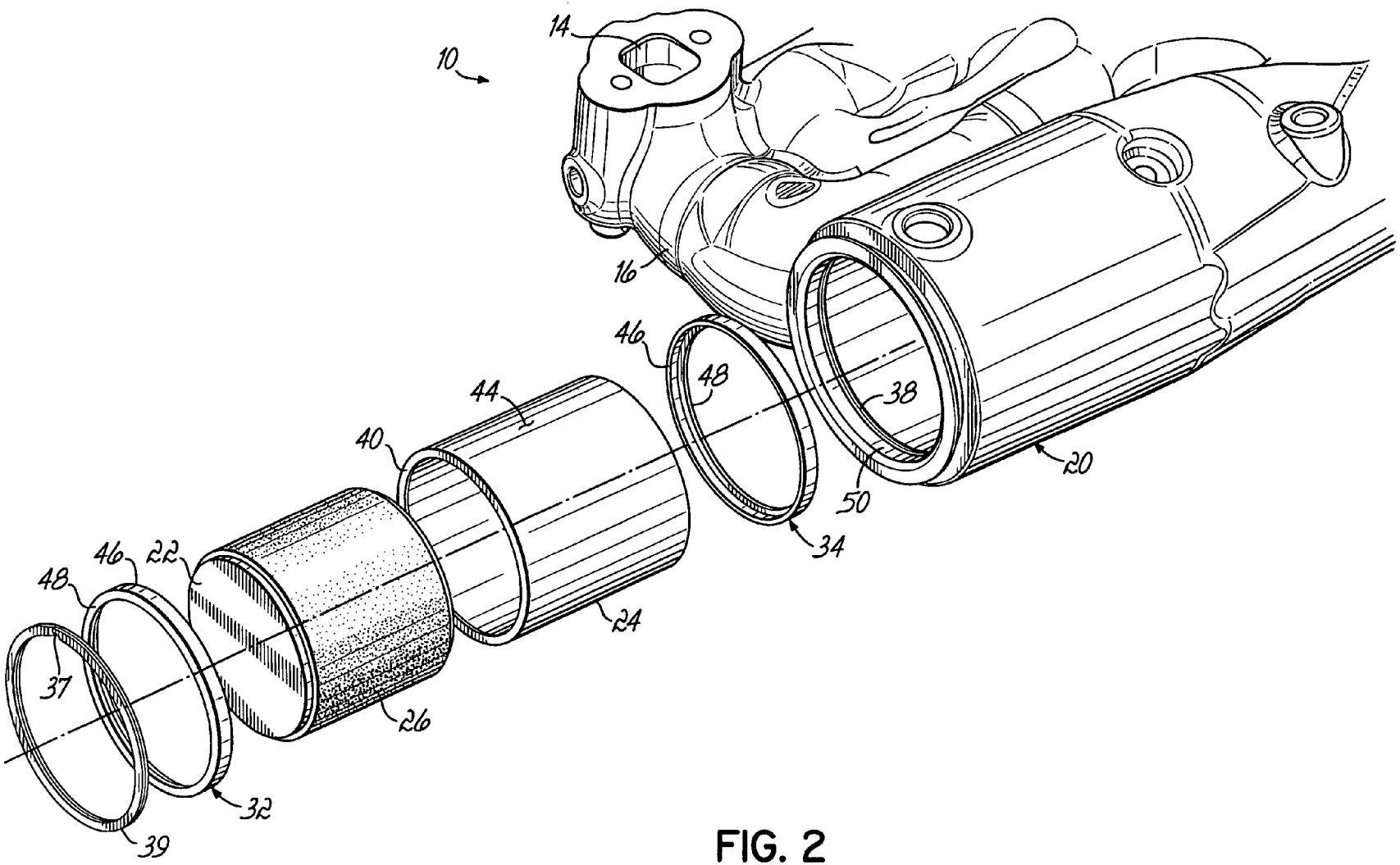
FIG. 2 is an exploded perspective view of the catalytic converter and the exhaust manifold of FIG. 1.
Figure 3:
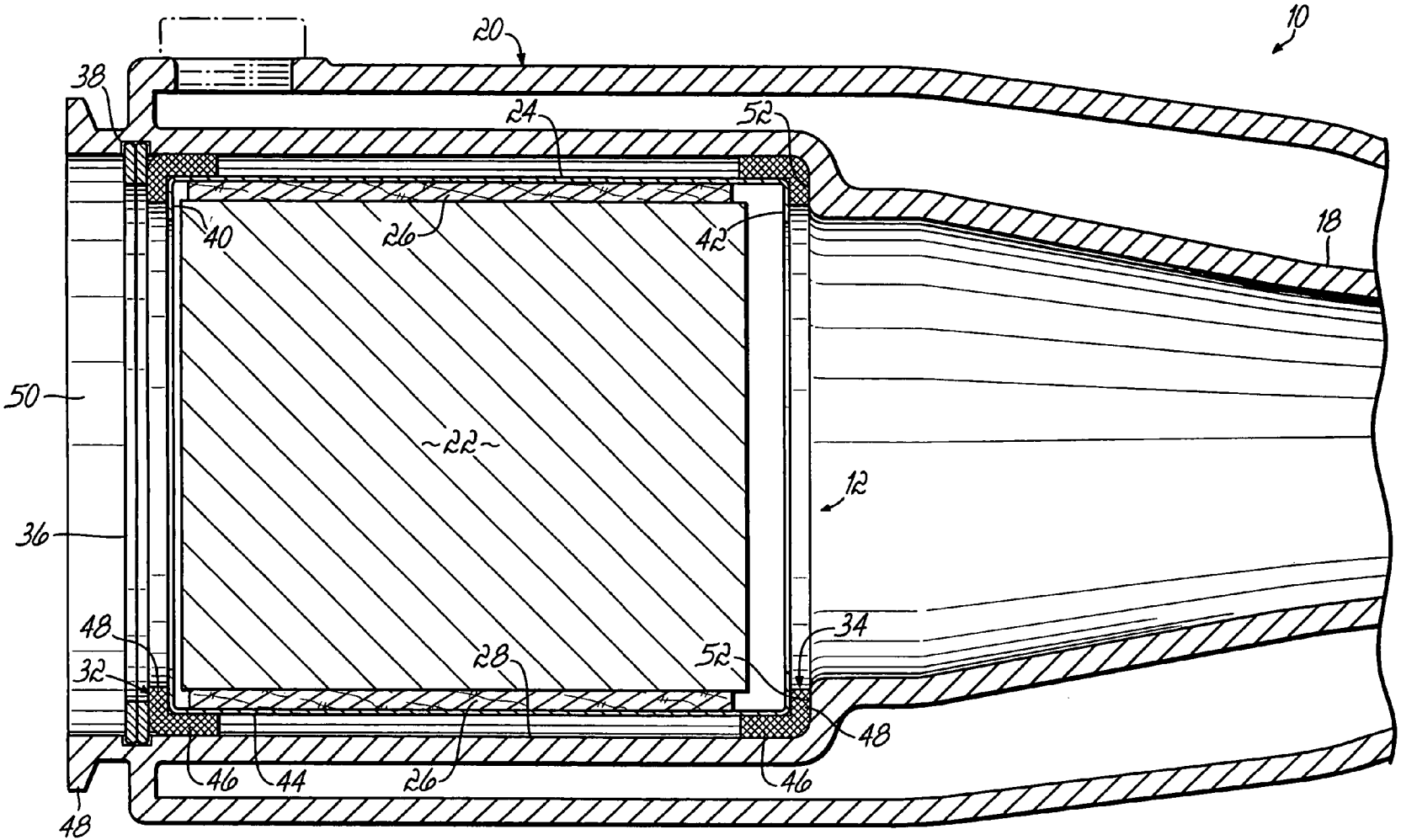
FIG. 3 is a cross sectional view through the catalytic converter and the assembled exhaust manifold and catalytic converter of FIG. 1.

With reference now to FIGS. 2 and 3, it will be seen that the catalytic converter cartridge 12 comprises a central cylindrical substrate 22 encased within a sheet metal shell 24 and retained within that shell by a compressible mat 26. The sheet metal shell is, in turn, retained within the central opening 28 of the can section 20 of the manifold by a pair of annular wire mesh seals 32, 34. The complete cartridge is retained within the opening 28 of the can section of the manifold by a snap-in-style retainer ring 36 located within an internal groove 38 formed on the inside wall of the opening 28 of the exhaust manifold.

The central generally cylindrical substrate 22 may be of circular or oval cross section or any other cross sectional shape, such as hexagonal or poly-sided. It may comprise any material designed for use in a gasoline or diesel engine environment and having the following characteristics: (capable of operating at temperatures up to about 800° C.), (2) capable of withstanding exposure to hydrocarbons, nitrogen oxides, carbon monoxide, particulate matter (e.g., soot and the like), carbon dioxide, and/or sulfur; and (3) having sufficient surface area and structural integrity to support a catalyst. Some possible materials include cordierite, silicon carbide, metal, metal oxides (e.g., alumina and the like), glasses, and the like, and mixtures comprising at least one of the foregoing materials. Preferably, substrate 22 comprises a ceramic material.

Disposed substantially throughout the substrate 22 is a catalyst capable of reducing the concentration of at least one component in the gas. The catalyst may be wash coated, imbibed, impregnated, physisorbed, chemisorbed, precipitated, or otherwise applied to the substrate. Possible catalyst materials include metals, such as platinum, palladium, rhodium, iridium, osmium, ruthenium, tantalum, zirconium, yttrium, cerium, nickel, manganese, copper, and the like, as well as oxides, alloys and combinations comprising at least one of the foregoing catalysts, and other catalysts.

The mat 26 a may be an intumescent material mat (e.g., a material that comprises vermiculite component, i.e., a component that expands upon the application of heat), or a non-intumescent material, or a combination thereof. These materials may comprise ceramic materials (e.g., ceramic fibers) and other materials such as organic and inorganic binders and the like, or combinations comprising at least one of the foregoing materials. Non-intumescent materials include materials such as those sold under the trademarks "NEXTEL" and "INTERAM 1101HT" by the "3M" Company, Minneapolis, Minn., or those sold under the trademark "FIBERFRAX" and "CC-MAX" by the Unifrax Co., Niagara Falls, N.Y., and the like. Intumescent materials include materials sold under the trademark "INTERAM" by the "3M" Company, Minneapolis, Minn., as well as those intumescents which are also sold under the aforementioned "FIBERFRAX"™, well as combinations thereof and others, including mats manufactured and sold by Saffil Ltd. and Ibiden Co. Ltd. The mat 26 is most often a fibrous material which, in addition to being able to withstand the temperatures of the engine exhaust, is sufficiently compressible and resilient as to firmly hold the varying dimension substrate within the sheet metal sleeve or shell 24 without breakage when subjected to engine vibration and jarring movement of the manifold.

The sheet metal shell or sleeve 24 within which the substrate 22 and mat 26 are contained is tubular in configuration and has inwardly turned flanges 40, 42 at its opposite ends. The choice of material for the shell depends upon the type of exhaust gas, the maximum temperature reached by the substrate, the maximum temperature of the exhaust gas stream, and the like. Suitable materials for the housing may comprise any material that is capable of resisting temperature, and corrosion. For example, ferrous materials can be employed such as ferritic stainless steels, as well as various metal alloys, such as alloys of nickel, chromium and/or iron.

The catalytic converter cartridges 12 may be assembled by one or more techniques, and, likewise, the mat material/substrate subassembly may be disposed within the housing one or more methods. For example, the mat material/substrate subassembly may be inserted into the shell 24 using a stuffing cone. The stuffing cone is a device that compresses the mat concentrically about the substrate. The stuffing cone then stuffs the compressed mat/substrate subassembly into the housing, such that an annular gap preferably forms between the substrate and the interior surface of the shell as the mat material becomes compressed about the substrate.

In an alternative method, the so-called "tourniquet" method of forming the catalytic converter comprises wrapping the shell (e.g., in the form of a sheet) around the mat material/substrate subassembly. The adjoining edges of the shell are welded together while the assembly is squeezed at rated pressures calculated to optimize the retention material density. Although this method has the disadvantages of increased cost due to the number of components that have to be processed and the added cost of welding wires and gases, it often is characterized as having improved retention material density control.

Figure 4:
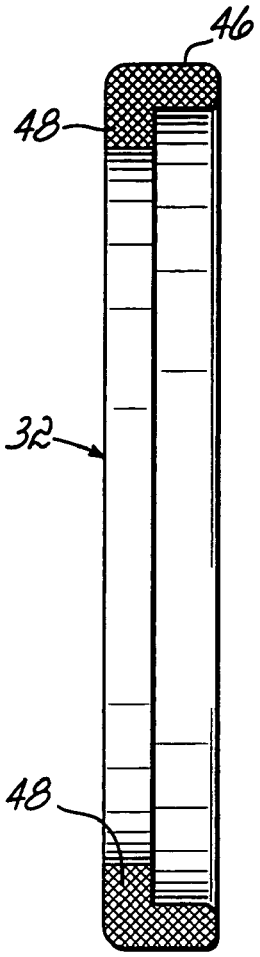
FIG. 4 is a cross sectional view of a wire mesh seal utilized in the catalytic converter cartridge of FIG. 1.

The wire mesh seals 32, 34 engage the flanges 40, 42, as well as the outside peripheral surface 44 of the shell 24 to retain the catalytic converter cartridge within the opening 28 of the exhaust manifold. With reference to FIG. 4, there is illustrated the details of the wire mesh seals 32, 34, only one of which is illustrated in FIG. 4 since the two seals are identical. These seals are made from a fine wire mesh which is able to withstand the heat of the exhaust gases from the engine with which the manifold and catalytic converter are utilized and still be sufficiently compressible so as to fixedly and sealingly hold the catalytic converter within the manifold. Each seal comprises an annular or oval or other shape section 46 which conforms to the cross sectional shape of the substrate and sheet metal shell. It surrounds the periphery of the metal shell 24 and has an inwardly turned flange section 48 which engages the end of the shell.

Figure 5:
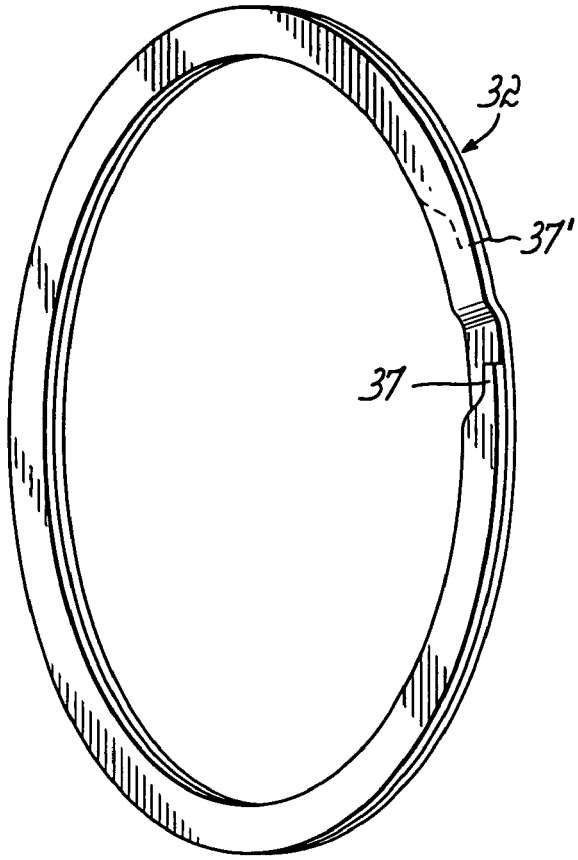
FIG. 5 is a perspective view of a retainer ring utilized in connection with the catalytic converter and manifold of FIG. 3.

As may be seen most clearly in FIG. 3, the completely assembled cartridge is retained within the opening 28 of the exhaust manifold by the snap-fit retainer ring (see FIG. 5) which is received within the groove 38 in the exhaust manifold. As illustrated in FIG. 5, the snap-in retainer ring is a conventional multiple revolution retainer ring having spaced ends 37, 37' which permit contraction of the ring for placement and insertion into the annular groove 38. The retainer ring could as well be a single revolution ring or any other shaped snap-in ring.

In order to assemble the catalytic converter cartridge within the central opening 28 in the manifold can 20, the cartridge, as illustrated in FIG. 1, is inserted through the end opening 50 of the can section 20 of the manifold. The cartridge having the seals 32, 34 applied thereto is inserted or pushed inwardly into that opening (preferably using a stuffing cone) until the flange 48 of the wire mesh seal 32 engages an abutment surface 52 of the manifold. The snap-in retainer ring 36 is then inserted into the groove 38 while compressed and allowed to expand into the groove 38 of the exhaust manifold. When so expanded, the inside surface of the retainer ring engages the flange 48 of the wire mesh seal 30 so as to lock the cartridge 12 within the can section 20 of the manifold 10.

In the event that the substrate 22 of the catalytic converter cartridge 12 should ever become clogged or broken or otherwise fail for any reason, the complete cartridge may be removed and replaced by a new cartridge 12 by simply compressing the snap-in retainer ring 36 and sliding the failed cartridge out of the opening. Thereafter, the new cartridge 12, again preferably using a stuffing cone, may be inserted and the retainer ring replaced in the groove so as to hold the new cartridge having new seals 32, 34 applied thereto within the can section of the manifold.

With reference now to FIG. 5, there is illustrated a conventional snap-in-style of retainer ring. Of course, other fastener elements could be used for the same purpose of locking the replaceable catalytic converter cartridge within the can section of the manifold. For example, a threaded ring could be used in lieu of a snap-in-style retainer ring or any other conventional style of fastener element could be utilized to secure the catalytic converter cartridge within the can section of the manifold.

While we have described only a single embodiment of our invention, persons skilled in this art will readily appreciate changes and modifications which may be made without departing from the spirit of our invention.

We claim:

1. An exhaust manifold and catalytic converter combination comprising:

an exhaust manifold having an opening near its terminal end for receiving a catalytic converter cartridge;

an easily and conveniently replaced catalytic converter cartridge located within said exhaust manifold opening, said catalytic converter cartridge comprising an inner substrate, a compressible mat surrounding said substrate and a sheet metal shell surrounding said compressible mat, said cartridge being supported within said opening by a pair of wire mesh seals located at opposite ends of said cartridge and extending between an inner wall of said manifold opening and an exterior wall of said sheet metal shell, said cartridge being replaceably retained within said manifold opening by a removable fastener element, each of said seals being engageable with an inwardly extending flange of said sheet metal shell at each end of said cartridge.

2. The combination of claim 1 wherein said opening and said cartridge are generally cylindrical in configuration and said wire mesh seals are generally annular in configuration.

3. The combination of claim 2 wherein each of said seals has an inwardly extending flange engageable with said inwardly extending flange of said sheet metal shell at each end of said cartridge.

4. The combination of claim 3 wherein said removable fastener element comprises a snap-in retainer ring located within an internal groove of said exhaust manifold.

5. The combination of claim 4 where said retainer ring is engageable with one of said wire mesh seals.

* * * * *